US011501719B2

(12) United States Patent
Chon et al.

(10) Patent No.: US 11,501,719 B2
(45) Date of Patent: Nov. 15, 2022

(54) DISPLAY DEVICE THAT COMPENSATES FOR IMAGE STICKING APPEARING ON AN IMAGE DISPLAYED THROUGH A DISPLAY PANEL AND METHOD OF DRIVING THE SAME

(71) Applicant: Samsung Display Co., Ltd., Yongin-Si (KR)

(72) Inventors: Yooshin Chon, Seoul (KR); Byoungkwan An, Suwon-si (KR)

(73) Assignee: SAMSUNG DISPLAY CO., LTD., Gyeonggi-do (KR)

( * ) Notice: Subject to any disclaimer, the term of this patent is extended or adjusted under 35 U.S.C. 154(b) by 0 days.

(21) Appl. No.: 17/308,424

(22) Filed: May 5, 2021

(65) Prior Publication Data

US 2022/0068217 A1 Mar. 3, 2022

(30) Foreign Application Priority Data

Aug. 27, 2020 (KR) ..... 10-2020-0108198

(51) Int. Cl.
*G09G 3/3275* (2016.01)

(52) U.S. Cl.
CPC ... *G09G 3/3275* (2013.01); *G09G 2300/0842* (2013.01); *G09G 2320/0257* (2013.01)

(58) Field of Classification Search
None
See application file for complete search history.

(56) References Cited

U.S. PATENT DOCUMENTS

| | | | | |
|---|---|---|---|---|
| 10,262,582 | B2 | 4/2019 | Han | |
| 2017/0206856 | A1* | 7/2017 | Song | G09G 5/363 |
| 2018/0268752 | A1* | 9/2018 | Zhuang | G09G 3/2074 |
| 2020/0349894 | A1* | 11/2020 | Ko | G09G 3/3208 |

FOREIGN PATENT DOCUMENTS

| | | | |
|---|---|---|---|
| KR | 1020170018152 | A | 2/2017 |
| KR | 101735388 | B1 | 5/2017 |

* cited by examiner

*Primary Examiner* — Chad M Dicke
(74) *Attorney, Agent, or Firm* — Cantor Colburn LLP

(57) ABSTRACT

A display device includes a display panel which displays an image, an image sticking compensator which receives image data, compensates for the image data based on lifespan data to generate lifespan compensation data, and a panel driver which provides data signals corresponding to the lifespan compensation data to the display panel. The image sticking compensator includes a compensator which receives the first cumulative data, generates the lifespan data based on the first cumulative data, compensates for the image data based on the lifespan data to generate the lifespan compensation data, a memory controller which receives the second cumulative data and the lifespan data from the compensator, a volatile memory which stores the second cumulative data from the memory controller, a main nonvolatile memory which stores the second cumulative data from the memory controller, and a sub-nonvolatile memory which stores the lifespan data from the memory controller.

19 Claims, 13 Drawing Sheets

DISPLAY DEVICE THAT COMPENSATES FOR IMAGE STICKING APPEARING ON AN IMAGE DISPLAYED THROUGH A DISPLAY PANEL AND METHOD OF DRIVING THE SAME

This application claims priority to Korean Patent Application No. 10-2020-0108198, filed on Aug. 27, 2020, and all the benefits accruing therefrom under 35 U.S.C. § 119, the content of which in its entirety is herein incorporated by reference.

BACKGROUND

1. Field

The disclosure relates to a display device and a method of driving the display device. More particularly, the disclosure relates to a display device that compensates for an image sticking appearing on an image displayed through a display panel and a method of driving the display device.

2. Description of the Related Art

Various types of display device, e.g., an organic light emitting display device, a liquid crystal display device, a plasma display device, and the like, are being widely used in various fields to provide image information.

Among various types of display device, the organic light emitting display device displays information, such as images, texts, etc., using a light generated when holes provided from an anode and electrons provided from a cathode are recombined with each other in an organic light emitting layer disposed between the anode and the cathode. The organic light emitting display device has desired characteristics, such as a wide viewing angle, a fast response speed, a low power consumption, etc., and thus, the organic light emitting display device has been spotlighted as a next-generation display.

SUMMARY

When an organic light emitting display device is driven for a long time, a light emitting element is burned in due to the increase of current stress, and as a result, image sticking occurs on areas where fixed patterns or logos are displayed for a long time.

The disclosure provides a display device in which an image sticking that may occur in a display panel is effectively prevented.

An embodiment of the invention provide a display device including a display panel which displays an image, an image sticking compensator which receives image data and first cumulative data, compensates for the image data based on lifespan data to generate lifespan compensation data, and stores second cumulative data and the lifespan data, and a panel driver which provides data signals corresponding to the lifespan compensation data to the display panel to drive the display panel. In such an embodiment, the image sticking compensator includes a compensator which receives the first cumulative data, generates the lifespan data based on the first cumulative data, compensates for the image data based on the lifespan data to generate the lifespan compensation data, and generates the second cumulative data based on the first cumulative data. In such an embodiment, the image sticking compensator further includes a memory controller which receives the second cumulative data and the lifespan data from the compensator, and a volatile memory which receives the second cumulative data from the memory controller and stores the received second cumulative data. In such an embodiment, the image sticking compensator further includes a main nonvolatile memory which receives the second cumulative data from the memory controller and stores the received second cumulative data, and a sub-nonvolatile memory which receives the lifespan data from the memory controller and stores the received lifespan data.

In an embodiment, the sub-nonvolatile memory may have a storage capacity less than a storage capacitor of the main nonvolatile memory.

In an embodiment, the compensator may generate burn-in data of a current frame based on the lifespan compensation data. In such an embodiment, the first cumulative data may be data generated by accumulating the burn-in data up to an immediately previous frame, and the second cumulative data may be data generated by accumulating the burn-in data of the current frame on the first cumulative data.

In an embodiment, the first and second cumulative data may include n bits of data, the lifespan data may include m bits of data, where each of n and m is a natural number equal to or greater than 1, and n is greater than m.

In an embodiment, the compensator may receive the first cumulative data from the memory controller, and when the display device is turned on, the memory controller may read out previous second cumulative data stored in the main nonvolatile memory in the immediately previous frame and store the read-out previous second cumulative data in the volatile memory as the first cumulative data.

In an embodiment, the memory controller may read out the lifespan data stored in the sub-nonvolatile memory and store the read-out lifespan data in the main nonvolatile memory when at least a portion of the main nonvolatile memory is damaged.

In an embodiment, the memory controller may expand the lifespan data to n bits of data and stores the expanded lifespan data in the main nonvolatile memory.

In an embodiment, the memory controller may read out the lifespan data stored in the sub-nonvolatile memory and store the read-out lifespan data in the volatile memory as the first cumulative data when the display device is turned on.

In an embodiment, the memory controller may expand the lifespan data to n bits of data and store the expanded lifespan data in the volatile memory as the first cumulative data.

In an embodiment, the memory controller may read out the second cumulative data stored in the volatile memory at a predetermined first period and store the read-out second cumulative data in the main nonvolatile memory. In such an embodiment, the memory controller may receive the lifespan data from the compensator at a predetermined second period and store the received lifespan data in the sub-nonvolatile memory.

In an embodiment, the first period and the second period may be set to be different from each other.

In an embodiment, the main nonvolatile memory may include a first main block and a second main block, and the memory controller may alternately store the second cumulative data in the first main block and the second main block.

In an embodiment, the sub-nonvolatile memory may include a first sub-block and a second sub-block, and the memory controller may alternately store the lifespan data in the first sub-block and the second sub-block.

In an embodiment, the display panel may further include a controller which receives an image signal from an outside and generates the image data based on the image signal.

An embodiment of the invention provide a method of driving a display device. In such an embodiment, the driving method of the display device includes receiving image data and first cumulative data, generating lifespan compensation data by compensating for the image data based on lifespan data to generate lifespan compensation data, storing second cumulative data and the lifespan data, and providing data signals corresponding to the lifespan compensation data to a display panel of the display device. In such an embodiment, the generating the lifespan compensation data includes receiving the first cumulative data to generate the lifespan data based on the first cumulative data, and compensating for the image data based on the lifespan data to generate the lifespan compensation data. In such an embodiment, the storing the second cumulative data and the lifespan data includes generating the second cumulative data based on the first cumulative data, storing the second cumulative data in a volatile memory by receiving the second cumulative data from a memory controller of the display device, storing the second cumulative data in a main nonvolatile memory, by receiving the second cumulative data from the memory controller; and storing the lifespan data in a sub-nonvolatile memory by receiving the lifespan data from the memory controller.

In an embodiment, the sub-nonvolatile memory may have a storage capacity less than a storage capacity of the main nonvolatile memory.

In an embodiment, the generating the lifespan compensation data may further include generating burn-in data of a current frame based on the lifespan compensation data. In such an embodiment, the first cumulative data may be data generated by accumulating the burn-in data up to an immediately previous frame, and the second cumulative data may be data generated by accumulating the burn-in data of the current frame on the first cumulative data. In such an embodiment, the first and second cumulative data may include n bits of data, and the lifespan data may include m bits of data, where each of n and m is a natural number equal to or greater than 1, and n is greater than m.

In an embodiment, the generating the lifespan compensation data may include reading out the lifespan data stored in the sub-nonvolatile memory when at least a portion of the main nonvolatile memory is damaged. In such an embodiment, the generating the lifespan compensation data may further include expanding the read-out lifespan data to n bits of data and storing expanded lifespan data in the main nonvolatile memory as the first cumulative data.

In an embodiment, the generating the lifespan compensation data may further include reading out the lifespan data stored in the sub-nonvolatile memory when the display device is turned on, expanding the read-out lifespan data to n bits of data, and storing the expanded lifespan data in the volatile memory as the first cumulative data.

In an embodiment, the storing the second cumulative data in the main nonvolatile memory may include storing the second cumulative data in a first main block of the main nonvolatile memory and storing the second cumulative data in a second main block of the main nonvolatile memory. In such an embodiment, the storing the lifespan data in the sub-nonvolatile memory includes storing the lifespan data in a first sub-block of the sub-nonvolatile memory and storing the lifespan data in a second sub-block of the sub-nonvolatile memory.

According to embodiments of the invention, as disclosed herein, when the display device is booted or turned on, the image data may be compensated for on the basis of the burn-in data accumulated based on the image data provided to the display panel before the power supply is cut off. Thus, the image sticking may be effectively prevented from occurring in the image displayed through the display panel. In such embodiments, even though the main nonvolatile memory that stores the accumulated burn-in data is damaged, the image data may be compensated for using the lifespan data stored in the sub-nonvolatile memory. Accordingly, the image sticking compensation operation may be normally performed even through the main nonvolatile memory is damaged.

BRIEF DESCRIPTION OF THE DRAWINGS

The above and other features of the disclosure will become readily apparent by reference to the following detailed description when considered in conjunction with the accompanying drawings, in which.

DETAILED DESCRIPTION

Figure 1:
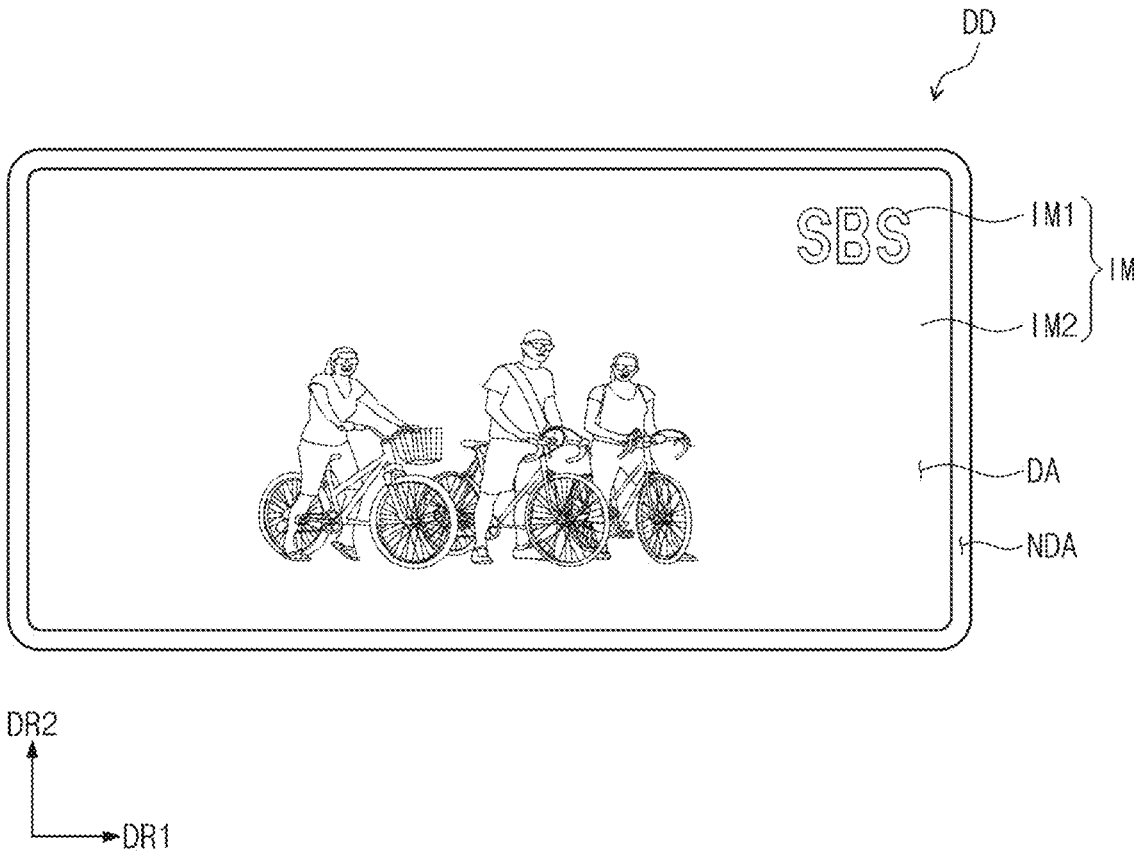
FIG. 1 is a plan view showing a display device according to an embodiment of the disclosure.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art.

In the disclosure, it will be understood that when an element or layer is referred to as being "on", "connected to" or "coupled to" another element or layer, it can be directly on, connected or coupled to the other element or layer or intervening elements or layers may be present.

Like numerals refer to like elements throughout. In the drawings, the thickness, ratio, and dimension of components are exaggerated for effective description of the technical content.

The terminology used herein is for the purpose of describing particular embodiments only and is not intended to be limiting. As used herein, "a", "an," "the," and "at least one" do not denote a limitation of quantity, and are intended to include both the singular and plural, unless the context clearly indicates otherwise. For example, "an element" has the same meaning as "at least one element," unless the context clearly indicates otherwise. "At least one" is not to be construed as limiting "a" or "an." "Or" means "and/or." As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the disclosure.

Spatially relative terms, such as "beneath", "below", "lower", "above", "upper" and the like, may be used herein for ease of description to describe one element or feature's relationship to another element s or feature s as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" can encompass both an orientation of above and below. The device may be otherwise oriented (rotated 90 degrees or at other orientations) and the spatially relative descriptors used herein interpreted accordingly.

Unless otherwise defined, all terms including technical and scientific terms used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

It will be further understood that the terms "comprises" and/or "comprising," "includes" and/or "including", when used in this specification, specify the presence of stated features, integers, steps, operations, elements, and/or components, but do not preclude the presence or addition of one or more other features, integers, steps, operations, elements, components, and/or groups thereof.

Embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, embodiments of the disclosure will be described in detail with reference to the accompanying drawings.

Figure 2:
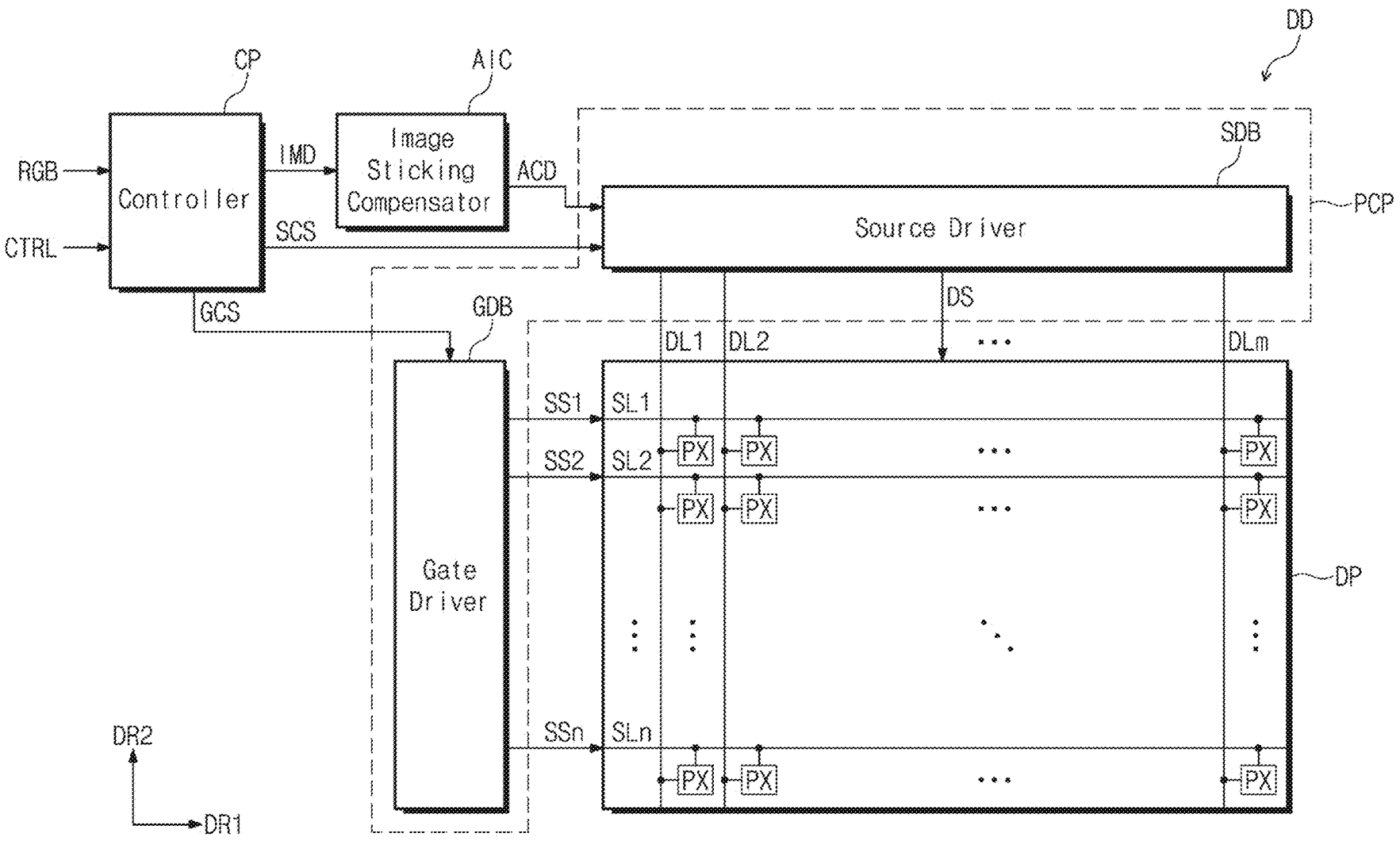
FIG. 2 is a block diagram showing a display device according to an embodiment of the disclosure.

FIG. 1 is a plan view showing a display device DD according to an embodiment of the disclosure, and FIG. 2 is a block diagram showing the display device DD according to an embodiment of the disclosure.

Referring to FIGS. 1 and 2, an embodiment of the display device DD may have a rectangular shape with long sides extending in a first direction DR1 and short sides extending in a second direction DR2 crossing the first direction DR1. The second direction DR2 may be substantially perpendicular to the first direction DR1. However, the shape of the display device DD is not be limited thereto or thereby, and the shape of the display device DD may be variously modified.

In an embodiment, the display device DD may be a large-sized display device, such as a television set, a monitor, or the like, or a small- and medium-sized display device, such as a mobile phone, a tablet computer, a car navigation unit, a game unit, or the like.

However, these are merely an example, and the display device DD may be employed in other electronic devices without departing from the disclosure.

Referring to FIGS. 1 and 2, an embodiment of the display device DD may include a display panel DP for displaying an image IM, a controller CP, an image sticking compensator AIC, and a panel driver PCP.

The display panel DP may include a display area DA, in which the image IM is displayed, and a non-display area NDA defined around the display area DA. The display area DA may be an area through which the image IM is displayed, and the non-display area NDA may be a bezel area through which no image is displayed. FIG. 1 shows an embodiment having a structure in which the non-display area NDA is defined to surround the display area DA, however, the disclosure is not be limited thereto or thereby. Alternatively, the non-display area NDA may be defined adjacent to only one side of the display area DA, for example.

The image IM may be displayed through the display area DA. The image IM may include a first image IM1 and a second image IM2. The first image IM1 may be an image displayed at a fixed position for a predetermined time or longer in a specific gray level. The first image IM1 may be a still image, and the second image IM2 may be a video or a still image. In one embodiment, for example, the first image IM1 may include a broadcaster logo, subtitles, date, time, and the like. The first image IM1 may include a title of a TV program. Hereinafter, for convenience of description, various images that are displayed at the fixed position for the predetermined time or longer in the specific gray level will all be referred to as the first image IM1. An area of the display area DA where the first image IM1 is displayed is referred to as a fixed area. The second image IM2 may be an image displayed through the other area of the display area DA except the fixed area.

The display panel DP may include a plurality of scan lines SL1 to SLn, a plurality of data lines DL1 to DLm, and a plurality of pixels PX. The scan lines SL1 to SLn may extend in the first direction DR1 and may be arranged in the second direction DR2 crossing the first direction DR1 to be substantially parallel to each other. The data lines DL1 to DLm may be arranged in the first direction DR1 to be substantially parallel to each other and may extend in the second direction DR2.

The pixels PX may be arranged in the first and second directions DR1 and DR2. As an example, the pixels PX may be arranged in a matrix form. Each of the pixels PX may be electrically connected to a corresponding one of the scan lines SL1 to SLn and a corresponding one of the data lines DL1 to DLm. Each pixel may be turned on in response to a scan signal applied thereto through a corresponding scan line among the scan lines and may receive data signals DS through a corresponding data line among the data lines, and thus, the image having a desired grayscale may be displayed. Each of the pixels PX may include a light emitting element (not shown) and a circuit unit (not shown) for controlling an emission of the light emitting element. The light emitting element may be an organic light emitting diode, for example, but not being limited thereto.

The organic light emitting diode may include a plurality of electrodes and a light emitting layer disposed between the electrodes and including an organic material. The organic light emitting diode included in the pixels PX in the fixed area may be burned-in due to the first image IM1 that is displayed through a same pixel for a long time. Accordingly, when an image different from the first image IM1 is displayed through the fixed area after the first image IM1 is displayed through the fixed area, the first image IM1 may remain in the first area, which is not desirable. At this time, a remained first image IM1 is called an image sticking.

The circuit unit may include a plurality of transistors and a capacitor electrically connected to the transistors.

The controller CP may receive image signals RGB and a control signal CTRL from an external source (not shown). The controller CP may convert a data format of the image signals RGB to a format appropriate to an interface between the controller CP and a source driver SDB to generate image data IMD. The controller CP may convert the control signal CTRL to generate a gate control signal GCS and a source control signal SCS. The controller CP may output the image data IMD, the source control signal SCS, and the gate control signal GCS.

The image sticking compensator AIC may receive the image data IMD from the controller CP. The image sticking compensator AIC may compensate for the received image data IMD and may generate lifespan compensation data ACD. Functions, configurations, and operations of the image sticking compensator AIC will be described later with reference to FIGS. 3A to 12.

In an embodiment, the panel driver PCP may receive the lifespan compensation data ACD from the image sticking compensator AIC and may receive the source control signal SCS and the gate control signal GCS. The panel driver PCP may provide data signals DS corresponding to the lifespan compensation data ACD to the display panel DP to drive the display panel DP. In one embodiment, for example, the panel driver PCP may include the source driver SDB and a gate driver GDB.

The source driver SDB may receive the source control signal SCS from the controller CP and may receive the lifespan compensation data ACD from the image sticking compensator AIC. The source driver SDB may convert the lifespan compensation data ACD into the data signals DS in response to the source control signal SCS and may output the data signals DS to the data lines DL1-DLm. The data signals DS may be analog voltages corresponding to gray-scale values of the lifespan compensation data ACD.

The gate driver GDB may receive the gate control signal GCS from the controller CP. The gate driver GDB may generate scan signals SS1-SSn based on the gate control signal GCS and may output the scan signals SS1-SSn to the scan lines SL1-SLn.

In an embodiment, the gate driver GDB may be built in or integrated into the display panel DP. In such an embodiment, the gate driver GDB may be formed in the non-display area NDA of the display panel DP through a thin film process used to form the pixels PX in the display area DA of the display panel DP.

Figure 3A:
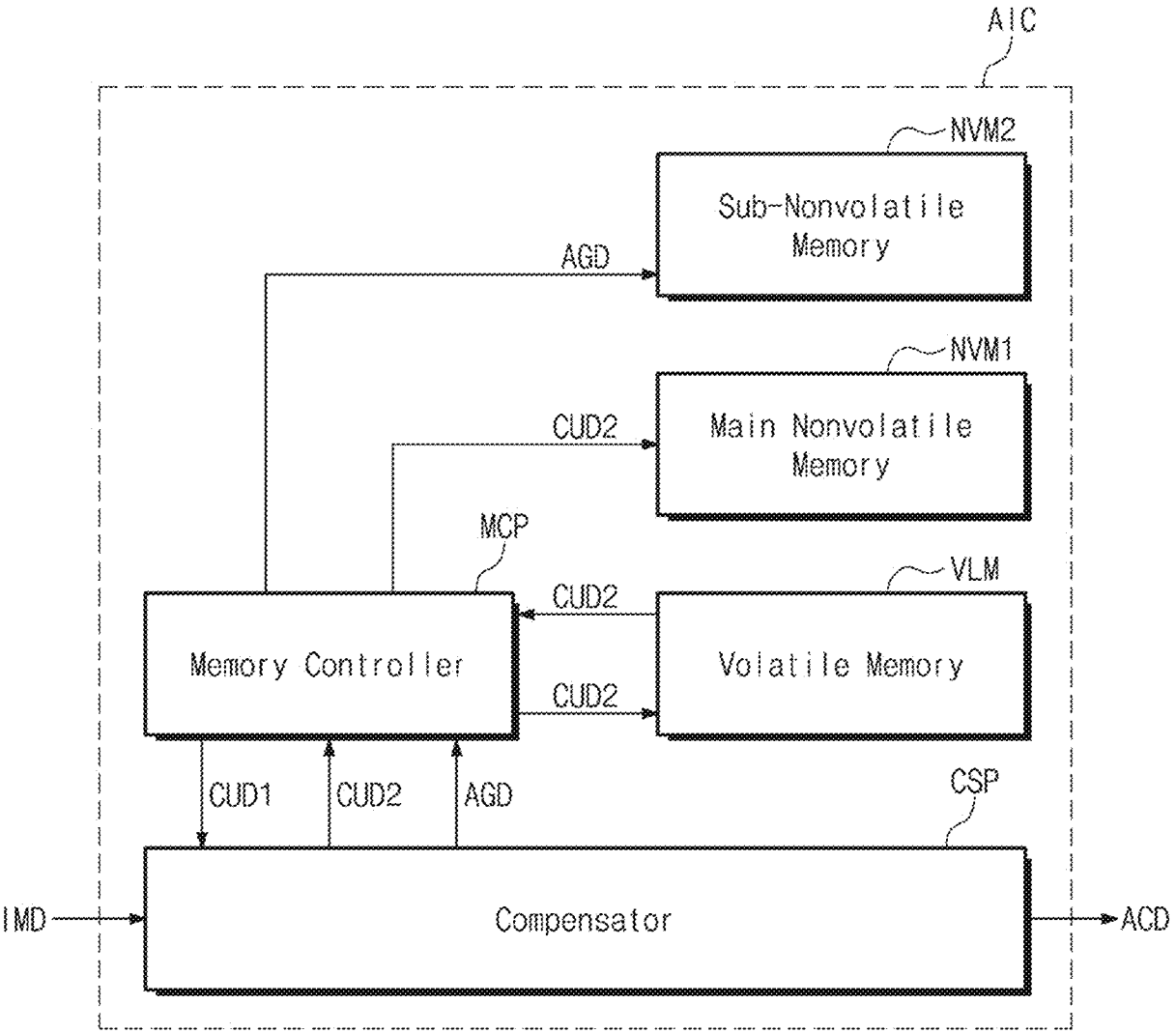
FIG. 3A is a block diagram showing an image sticking compensator according to an embodiment of the disclosure.
Figure 3B:
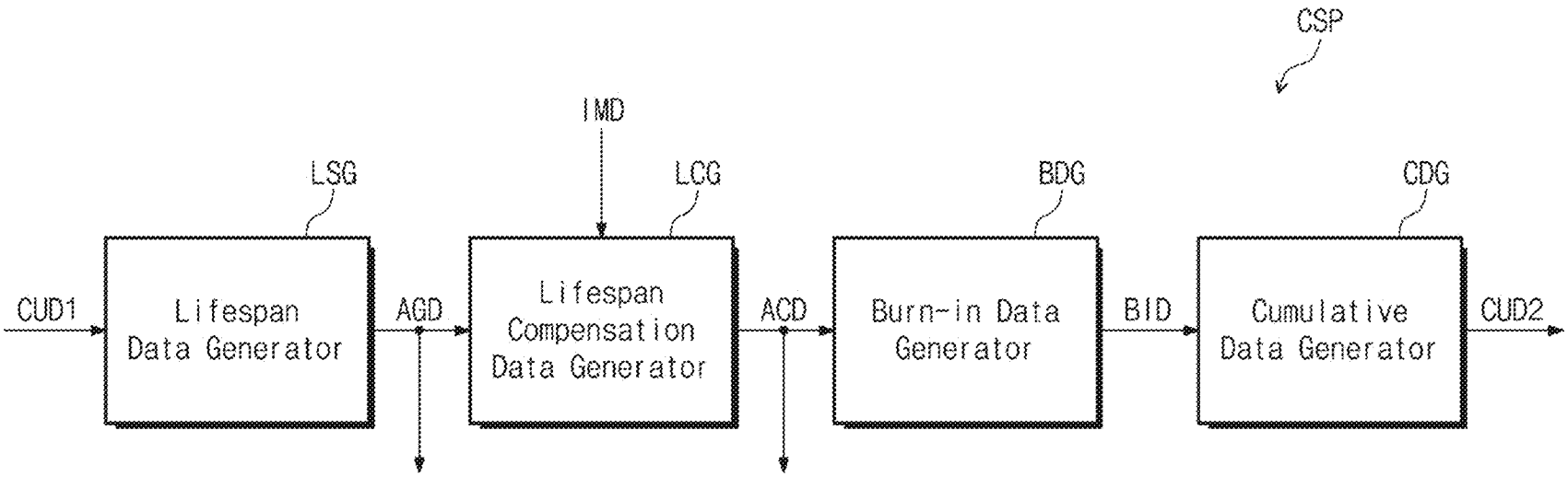
FIG. 3B is a block diagram showing the compensator CSP according to an embodiment of the disclosure.
Figure 4:
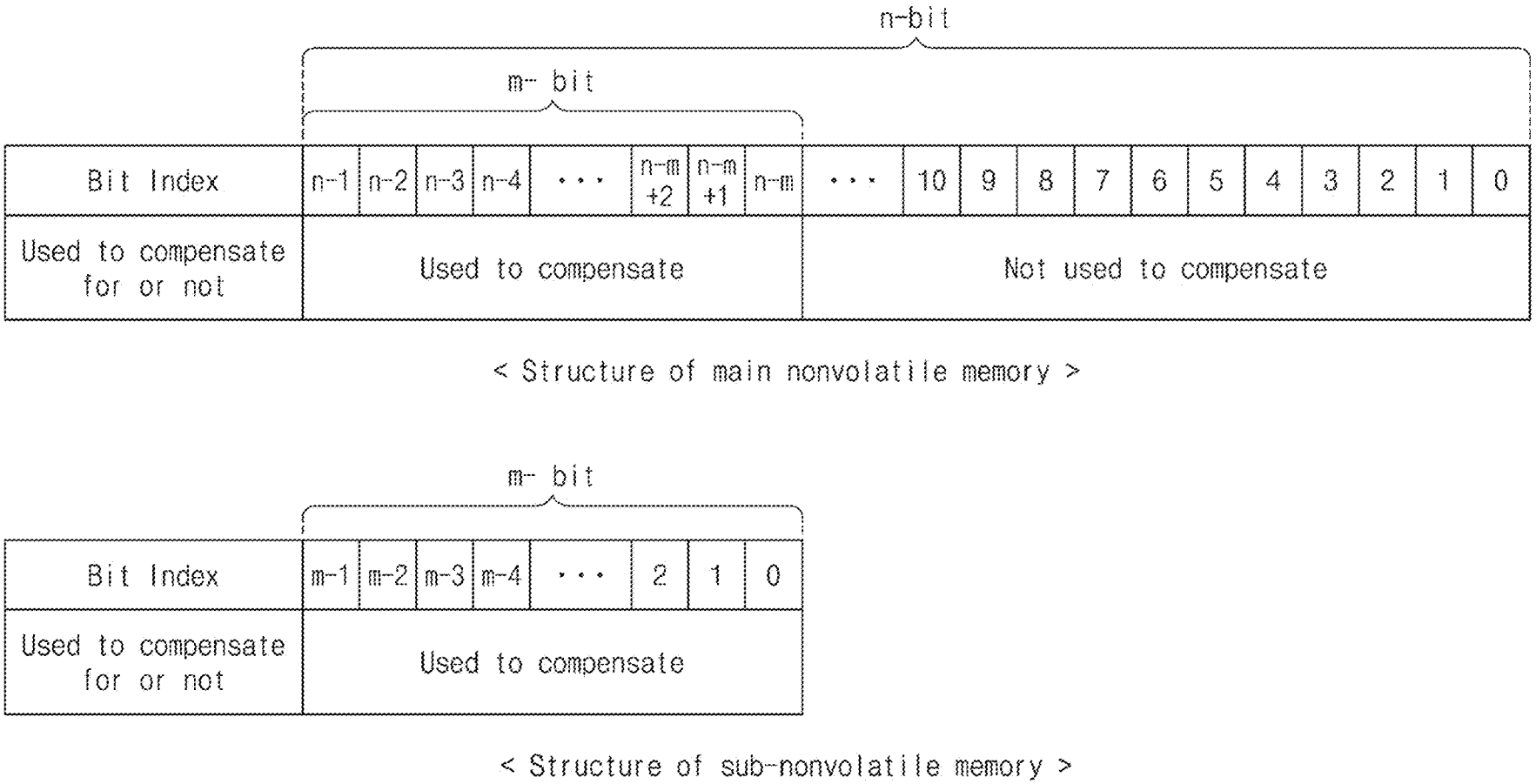
FIG. 4 is a view showing a structure of main and sub-nonvolatile memories according to an embodiment of the disclosure.
Figure 5:
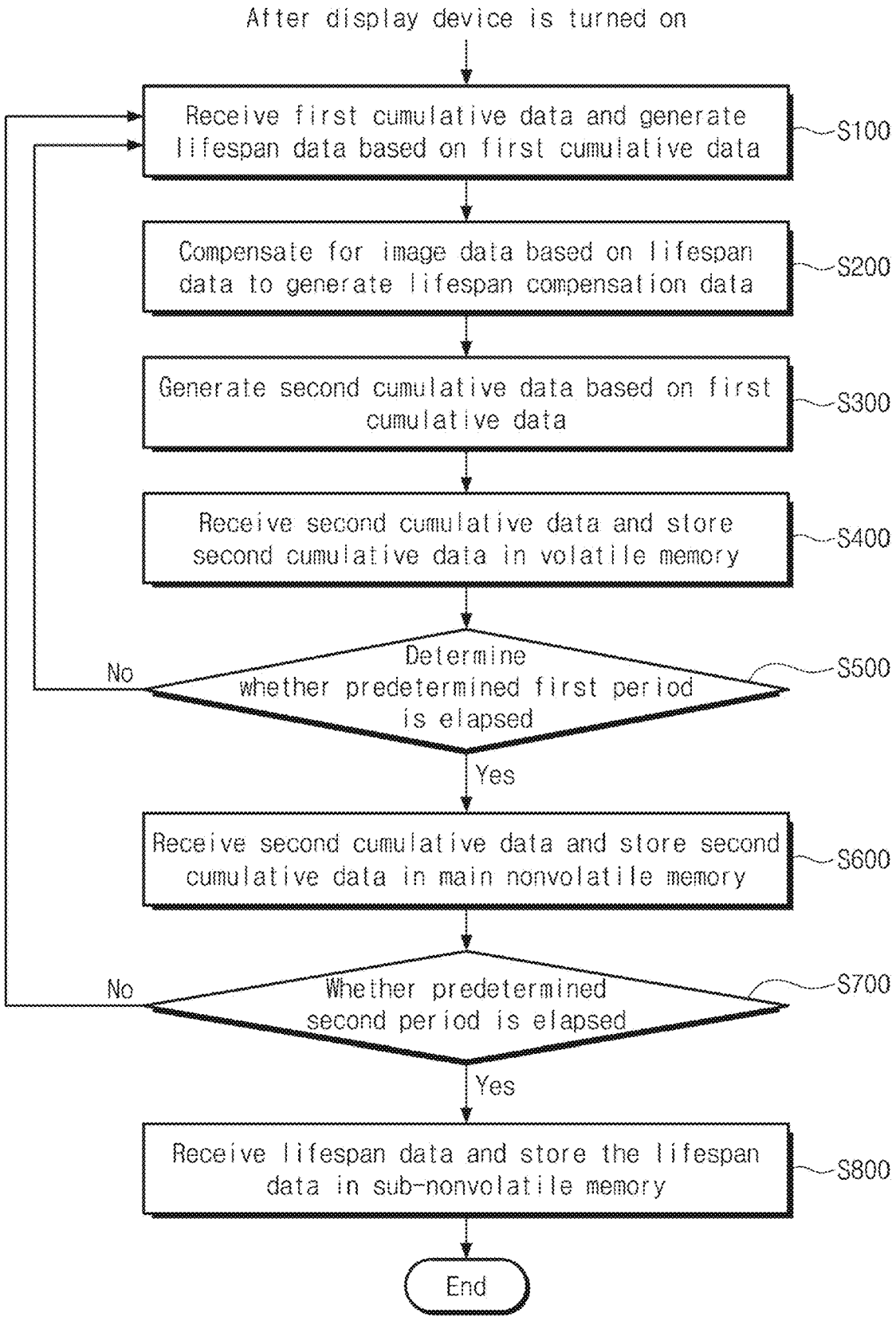
FIG. 5 is a flowchart showing an operation of the image sticking compensator shown in FIG. 3A.

FIG. 3A is a block diagram showing the image sticking compensator AIC according to an embodiment of the disclosure. FIG. 3B is a block diagram showing the compensator CSP according to an embodiment of the disclosure. FIG. 4 is a view showing a structure of main and sub-nonvolatile memories NVM1 and NVM2 according to an embodiment of the disclosure. FIG. 5 is a flowchart showing an operation of the image sticking compensator shown in FIG. 3A.

Referring to FIG. 3A and FIG. 3B, an embodiment of the image sticking compensator AIC may include a compensator CSP, a memory controller MCP, a volatile memory VLM, the main nonvolatile memory NVM1, and the sub-nonvolatile memory NVM2.

In an embodiment, the image sticking compensator AIC may receive the image data IMD from the controller CP (refer to FIG. 2) and may generate first cumulative data CUD1 by a memory controller MCP therein. The image sticking compensator AIC may compensate for the image data IMD based on lifespan data AGD and may generate the lifespan compensation data ACD. The image sticking compensator AIC may store second cumulative data CUD2 and the lifespan data AGD. The image sticking compensator AIC may generate the lifespan compensation data ACD obtained by compensating for the image data IMD to prevent the image sticking from being perceived by a viewer of the display device DD. Hereinafter, functions and operations of the image sticking compensator AIC will be described in detail based on components CSP, MCP, VLM, NVM1 and NVM2 included in the image sticking compensator AIC.

In an embodiment, the compensator CSP may receive the image data IMD from the controller CP and may receive the first cumulative data CUD1 from the memory controller MCP. The compensator CSP may include a lifespan data generator LSG, a lifespan compensation data generator LCG, a burn-in data generator BDG and a cumulative data generator CDG. The lifespan data generator LSG may receive the first cumulative data CUD1 from the memory controller MCP and generate the lifespan data AGD based on the first cumulative data CUD1. The lifespan compensation data generator LCG may receive the image data IMD from the controller CP and generate the lifespan compensation data ACD obtained by compensating for the image data IMD based on the lifespan data AGD.

The burn-in data generator BDG may generate burn-in data BID based on the lifespan compensation data ACD. The burn-in data may indicate a degree of burn-in of the pixels PX (refer to FIG. 2) included in the display panel DP when the image IM (refer to FIG. 1) is displayed through the display panel DP (refer to FIG. 1). When the data signals DS corresponding to the lifespan compensation data ACD are provided to the display panel DP in a current frame and the image IM corresponding to the data signals DS is displayed through the display panel DP, the compensator CSP may generate the burn-in data BID of the current frame based on the lifespan compensation data ACD. Data generated by the burn-in data accumulated up to an immediately previous frame are referred to as the "first cumulative data CUD1".

The cumulative data generator CDG may generate the second cumulative data CUD2 based on the first cumulative data CUD1 and the burn-in data BID. The cumulative data generator CDG may accumulate the burn-in data BID of the current frame to the first cumulative data CUD1 and may generate the second cumulative data CUD2. In one embodiment, for example, the first cumulative data CUD1 may be data generated by the burn-in data accumulated up to the immediately previous frame and the second cumulative data CUD2 are data generated by the burn-in data accumulated up to the current frame, such that the first and second cumulative data CUD1 and CUD2 may have the number of bits greater than the number of bits constituting burn-in data for each frame.

The compensator CSP may determine a burn-in degree of the pixels PX up to the immediately previous frame based on the first cumulative data CUD1. The compensator CSP may compensate for the image data IMD to prevent the image sticking from being generated in the display panel DP of the current frame due to a deterioration of the pixels PX and from being perceived by the viewer. In one embodiment, for example, the compensator CSP may compensate for the image data IMD to allow a grayscale value of the lifespan compensation data ACD to become greater than a grayscale value of the image data IMD. Data generated by the compensator CSP based on the first cumulative data CUD1 to compensate for the image data IMD are referred to as the lifespan data AGD. In such an embodiment, each of the first cumulative data CUD1 and the second cumulative data CUD2 may have n-bits of data, and the lifespan data AGD may have m-bits of data. Here, each of "n" and "m" is a natural number equal to or greater than 1, and "n" is greater than "m". In an embodiment, the lifespan data AGD used to compensate for the image data IMD may have the m-bits of data, which are selected from the n-bits of data of the first cumulative data CUD1. In such an embodiment, criteria to select the m-bits of data among the n-bits of data of the first cumulative data CUD1 may be changed depending on a size of the display panel DP, a driving speed of the display device DD, a cumulative time during which the image IM is displayed, a grayscale of the image IM, and the like. In one embodiment, for example, "n" may be 42, and "m" may be 10. However, the disclosure should not be limited thereto or thereby. In one alternative embodiment, for example, the lifespan data AGD and the first cumulative data CUD1 may have a same number of bits as each other.

The memory controller MCP may receive the second cumulative data CUD2 and the lifespan data AGD from the compensator CSP. The memory controller MCP may store the second cumulative data CUD2 received from the compensator CSP into the volatile memory VLM.

The memory controller MCP may read out the second cumulative data CUD2 from the volatile memory VLM and may store the read-out second cumulative data CUD2 into the main nonvolatile memory NVM1. In one embodiment, for example, the memory controller MCP may read out the second cumulative data CUD2 from the volatile memory VLM in a predetermined first period and may store the read-out second cumulative data CUD2 into the main nonvolatile memory NVM1.

The memory controller MCP may receive the lifespan data AGD from the compensator CSP and may store the received lifespan data AGD into the sub-nonvolatile memory NVM2. In one embodiment, for example, the memory controller MCP may receive the lifespan data AGD from the compensator CSP in a predetermined second period and may store the received lifespan data AGD into the sub-nonvolatile memory NVM2. In such an embodiment, the first period and the second period may be set to be different from each other. In one embodiment, for example, the second period may be set to be greater than the first period.

The volatile memory VLM may receive the second cumulative data CUD2 from the memory controller MCP and store the received second cumulative data CUD2. The main nonvolatile memory NVM1 may receive the second cumulative data CUD2 from the memory controller MCP and store the received second cumulative data CUD2. The sub-nonvolatile memory NVM2 may receive the lifespan data AGD from the memory controller MCP and store the received lifespan data AGD.

A memory is broadly classified into the volatile memory VLM and the nonvolatile memories NVM1 and NVM2. Data are quickly read out from and written in the volatile memory VLM, but the stored data in the volatile memory VLM are lost when an external power supplied to the volatile memory VLM is cut off. The volatile memory VLM includes a dynamic random-access memory ("DRAM"), a Static random-access memory ("SRAM"), or the like. On the other hand, although the external power supplied to the nonvolatile memories NVM1 and NVM2 is cut off, data stored in the nonvolatile memories NVM1 and NVM2 are maintained. The nonvolatile memories NVM1 and NVM2 include an electrically erasable programmable read only memory ("EEPROM"), a flash memory, or the like. Accordingly, the display device DD uses the volatile memory VLM when reading out data stored in the memory and writing data to the memory in real time. However, the nonvolatile memories NVM1 and NVM2 are used to store data that is desired to be preserved even when the power of the display device DD is turned off. In an embodiment of the disclosure, when the power is supplied to the display device DD, the image sticking compensator AIC may use the volatile memory VLM to allow the compensator CSP to compensate for the image data IMD in real time and to output the lifespan compensation data ACD. In such an embodiment, when the display device DD is turned on again after the power supply to the display device DD is cut off, the image sticking compensator AIC may use the main nonvolatile memory NVM1 and the sub-nonvolatile memory NVM2 to utilize the second cumulative data CUD2 in which the burn-in data of the pixels PX are accumulated before the power supply to the display device DD is cut off.

Referring to FIG. 4, in an embodiment, a storage capacity of the sub-nonvolatile memory NVM2 may be less than a storage capacity of the main nonvolatile memory NVM1.

The second cumulative data CUD2 stored in the main nonvolatile memory NVM1 may have n bits (0 to n−1) of data. Among the n bits (0 to n−1) of data, only m bits (n−m to n−1) of data may be used to compensate for the image sticking in an image sticking compensation algorithm logic included in the compensator CSP, and the other bits of data may not be used to compensate for the image sticking. However, the second cumulative data CUD2, in which the burn-in data are accumulated up to the current frame, are stored in the main nonvolatile memory NVM1 in addition to the burn-in data for each frame, and thus, the burn-in of the pixels PX by the image IM displayed up to the current frame may be accurately reflected when the image data IMD is compensated in a next frame. Accordingly, the main nonvolatile memory NVM1 may have the storage capacity in which the second cumulative data CUD2 having the n bits (0 to n−1) of data are stored.

In such an embodiment, the lifespan data AGD stored in the sub-nonvolatile memory NVM2 may have m bits (0 to m−1) of data. The sub-nonvolatile memory NVM2 may store the m bits (0 to m−1) of data used to compensate for the image sticking in the image sticking compensation algorithm logic. The lifespan data AGD may be data generated based on the first cumulative data CUD1 to compensate for the image data IMD in the immediately previous frame. Even though the second cumulative data CUD2 having the n bits are not stored in the sub-nonvolatile memory NVM2 and only the lifespan data AGD having the m bits (0 to m−1) are stored in the sub-nonvolatile memory NVM2, the image data IMD may be compensated in the next frame by partially reflecting information on the deterioration of the pixels PX due to image IM displayed up to the current frame. The sub-nonvolatile memory NVM2 may have the storage capacity in which the lifespan data AGD having the m bits (0 to m−1) of data are stored. Therefore, the storage capacity of the sub-nonvolatile memory NVM2 may be less than the storage capacitor of the main nonvolatile memory NVM1. Accordingly, in such an embodiment, although the sub-nonvolatile memory NVM2 is added to the image sticking compensator AIC, an increase in total size of the image sticking compensator AIC by the sub-nonvolatile memory NVM2 may be minimized. In such an embodiment, a time duration for the memory controller MCP to read out data stored in the sub-nonvolatile memory NVM2 may be shorter than a time duration for the memory controller MCP to read out data stored in the main nonvolatile memory NVM1. In an embodiment, the n bits of the second cumulative data CUD2 may be stored in the sub-nonvolatile memory NVM2. In such an embodiment, the storage capacity of the sub-nonvolatile memory NVM2 may be substantially the same as the storage capacity of the main nonvolatile memory NVM1. In such an embodiment, the time duration for the memory controller MCP to read out the data stored in the sub-nonvolatile memory NVM2 may be substantially the same as the duration time for the memory controller MCP to read out the data stored in the main nonvolatile memory NVM1.

Hereinafter, the operation of an embodiment of the image sticking compensator AIC while the display device DD is being operated will be described in detail with reference to FIG. 5.

Referring to FIGS. 2, 3, and 5, after the display device DD is turned on, the image sticking compensator AIC of the display device DD may receive the image data IMD and the first cumulative data CUD1 to compensate for the image sticking. The image sticking compensator AIC may compensate for the image data IMD based on the lifespan data AGD and may generate the lifespan compensation data ACD. Then, the image sticking compensator AIC may store the second cumulative data CUD2 and the lifespan data AGD. The panel driver PCP may provide the data signals DS corresponding to the lifespan compensation data ACD to the display panel DP. The display panel DP may display the image IM (refer to FIG. 1) corresponding to the data signals DS. Hereinafter, the operation of the image sticking compensator AIC will be described in detail.

The generating of the lifespan compensation data ACD by the image sticking compensator AIC may include receiving the first cumulative data CUD1 and generating the lifespan data AGD based on the first cumulative data CUD1 (S100) and generating the lifespan compensation data ACD obtained by compensating for the image data IMD based on the lifespan data AGD (S200).

In the generating of the lifespan data AGD (S100), the memory controller MCP may read out the second cumulative data CUD2 from the volatile memory VLM, and the compensator CSP may receive the second cumulative data CUD2 read-out by the memory controller MCP as the first cumulative data CUD1. The compensator CSP may generate the lifespan data AGD based on the received first cumulative data CUD1.

In the generating of the lifespan compensation data ACD (S200), the compensator CSP may generate the lifespan compensation data ACD obtained by compensating for the received image data IMD based on the lifespan data AGD.

The storing of the second cumulative data CUD2 and the lifespan data AGD by the image sticking compensator AIC may include generating the second cumulative data CUD2 based on the first cumulative data CUD1 (S300), and receiving the second cumulative data CUD2 and storing the second cumulative data CUD2 in the volatile memory VLM (S400).

In the generating of the second cumulative data CUD2 (S300), the second cumulative data CUD2 may be generated based on the received first cumulative data CUD1 and the burn-in data that are generated on the basis of the lifespan compensation data ACD.

In the storing of the second cumulative data CUD2 in the volatile memory VLM (400), the memory controller MCP may receive the second cumulative data CUD2 from the compensator CSP and may store the received second cumulative data CUD2 in the volatile memory VLM. The second cumulative data CUD2 may be stored in the volatile memory VLM, and the compensator CSP may read out the second cumulative data CUD2 stored in the volatile memory VLM in real time to compensate for the image data IMD.

Then, the image sticking compensator AIC may determine whether the predetermined first period is elapsed (S500). When the first period is not elapsed, the image sticking compensator AIC repeatedly performs the above-mentioned operations S100 to 5400.

When the first period is elapsed, the image sticking compensator AIC may receive the second cumulative data CUD2 and may store the second cumulative data CUD2 in the main nonvolatile memory NVM1 (S600). The image sticking compensator AIC may store the second cumulative data CUD2 in the main nonvolatile memory NVM1, and then may determine whether the predetermined second period is elapsed (S700).

When the second period is not elapsed, the image sticking compensator AIC repeatedly performs the above-mentioned operations S100 to S600. When the second period is elapsed, the image sticking compensator AIC may receive the lifespan data AGD and may store the received lifespan data AGD in the sub-nonvolatile memory NVM2 (S800).

In the storing of the second cumulative data CUD2 in the main nonvolatile memory NVM1 (S600), the memory controller MCP may receive the second cumulative data CUD2 from the compensator CSP and may store the received second cumulative data CUD2 in the main nonvolatile memory NVM1. Accordingly, in such an embodiment, even though the power supply to the display device DD is cut off, the second cumulative data CUD2 may be preserved since the second cumulative data CUD2 are stored in the main nonvolatile memory NVM1. In such an embodiment, when the display device DD is turned on again, the second cumulative data CUD2 stored in the main nonvolatile memory NVM1 are read out and stored in the volatile memory VLM, and thus, the compensator CSP may compensate for the image data IMD based on the burn-in data of the pixels PX obtained before the power supply to the display device DD is cut off.

Then, the image sticking compensator AIC may determine whether the predetermined second period is elapsed (S700).

In the storing of the lifespan data AGD in the sub-nonvolatile memory NVM2 (S800), the memory controller MCP may receive the lifespan data AGD from the compensator CSP and may store the received lifespan data AGD in the sub-nonvolatile memory NVM2. In such an embodiment, when the lifespan data AGD are stored in the sub-nonvolatile memory NVM2, the lifespan data AGD may be preserved even though the power supply to the display device DD is cut off. In such an embodiment, although at least a portion of the main nonvolatile memory NVM1 is damaged and the second cumulative data CUD2 stored in the main nonvolatile memory NVM1 are not read out, the lifespan data AGD stored in the sub-nonvolatile memory NVM2 may be read out and may be stored in the volatile memory VLM. Accordingly, the compensator CSP may compensate for the image data IMD in the current frame based on the lifespan data AGD used to compensate for the image data IMD in the immediately previous frame before the power supply to the display device DD is cut off.

Figure 6:
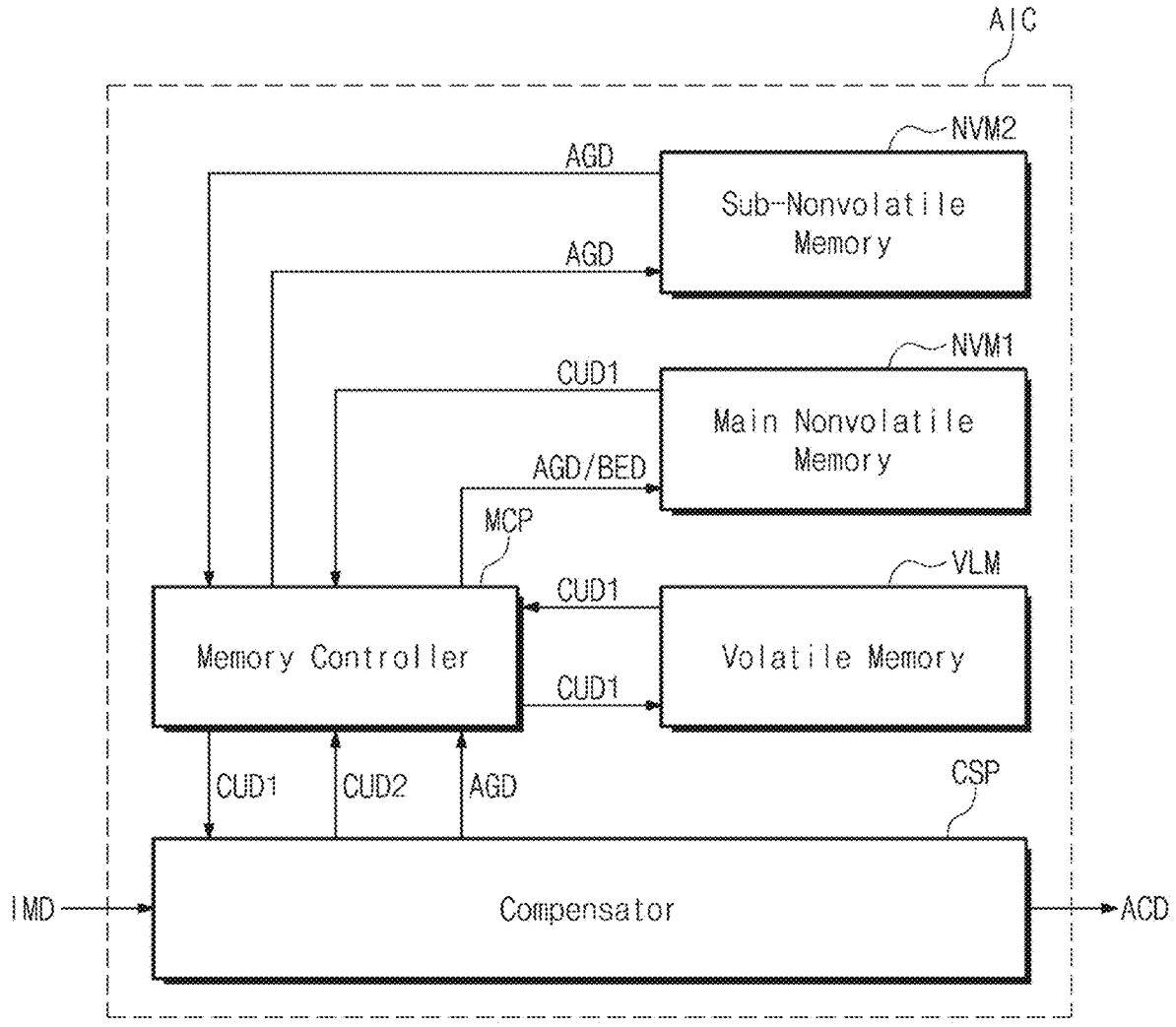
FIG. 6 is block diagram showing an operation of an image sticking compensator according to an embodiment of the disclosure when at least a portion of the main nonvolatile memory is damaged.
Figure 7:
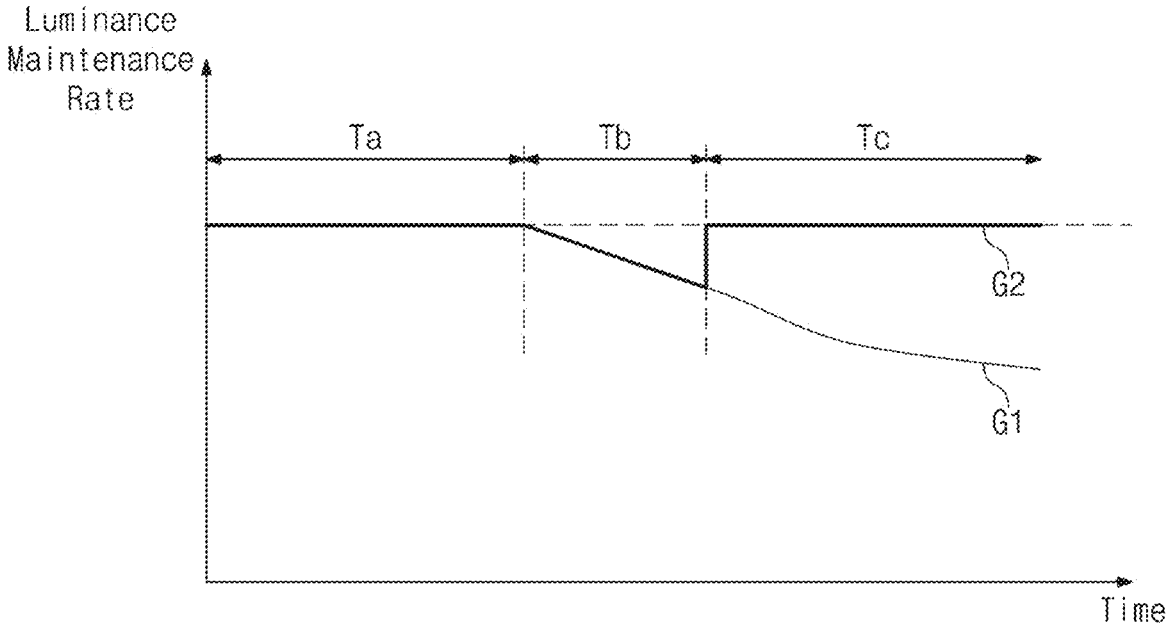
FIG. 7 is a graph showing an effect obtained depending on the presence or absence of the sub-nonvolatile memory according to an embodiment of the disclosure.
Figure 8:
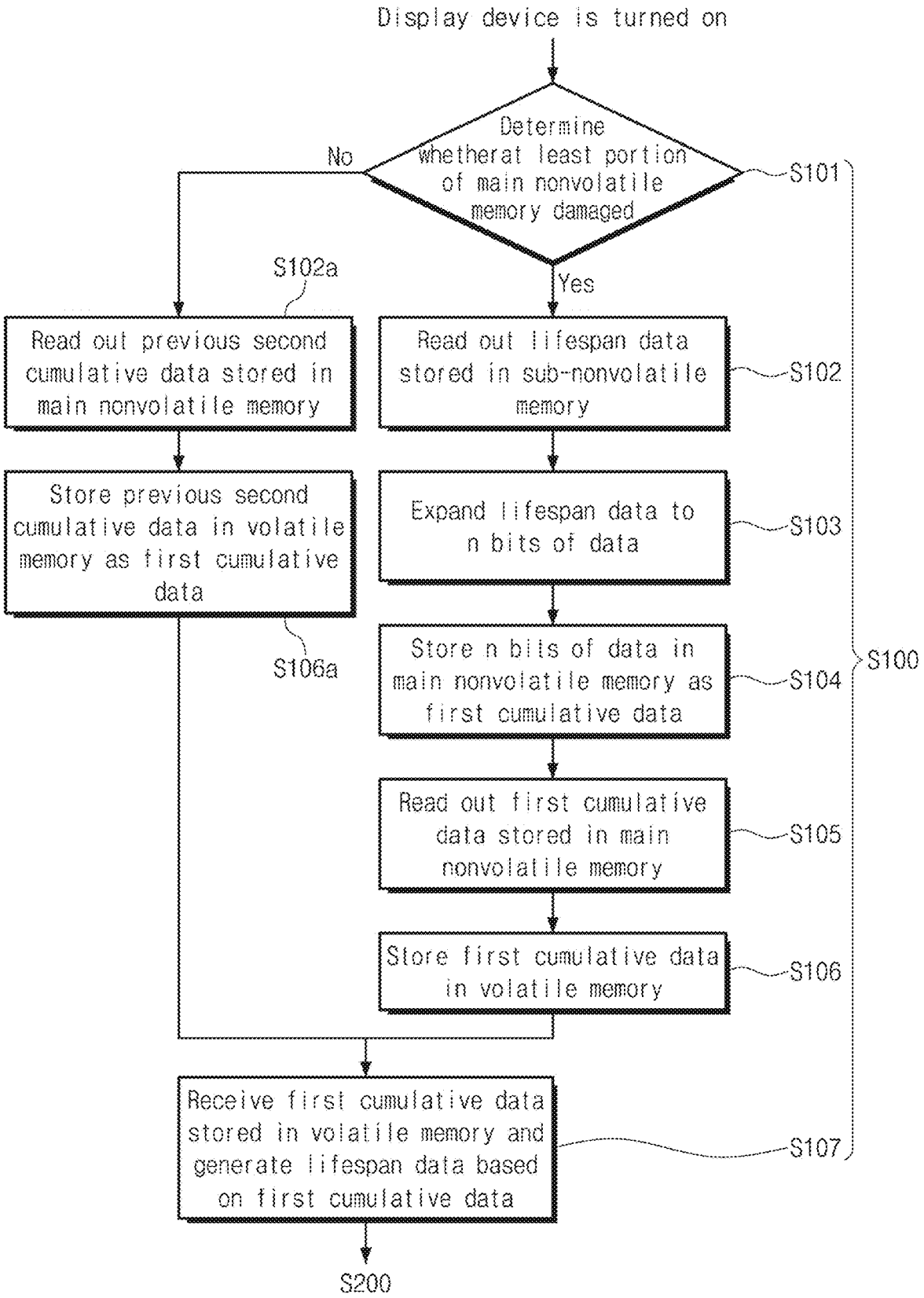
FIG. 8 is a flowchart showing an operation of the image sticking compensator shown in FIG. 6.

FIG. 6 is block diagram showing an operation of the image sticking compensator AIC according to an embodiment of the disclosure when at least a portion of the main nonvolatile memory NVM1 is damaged. FIG. 7 is a graph showing an effect obtained depending on the presence or absence of the sub-nonvolatile memory according to an embodiment of the disclosure. FIG. 8 is a flowchart showing an operation of the image sticking compensator shown in FIG. 6.

Hereinafter, any repetitive detailed descriptions of the same elements in FIG. 6 as those described above with reference to FIG. 3A will be omitted.

Referring to FIGS. 6 and 8, in an embodiment, when at least a portion of the main nonvolatile memory NVM1 is damaged, the second cumulative data CUD2 stored in the main nonvolatile memory NVM1 may be lost or may be damaged. When the display device is turned on while the second cumulative data CUD2 are lost or are damaged, the memory controller MCP may not read out the second cumulative data CUD2 from the main nonvolatile memory NVM1.

The memory controller MCP may determine whether at least the portion of the main nonvolatile memory NVM1 is damaged before reading out the second cumulative data CUD2 (S101). When it is determined that at least the portion of the main nonvolatile memory NVM1 is damaged, the memory controller MCP may read out the lifespan data AGD stored in the sub-nonvolatile memory NVM2 (S102). The memory controller MCP may expand the lifespan data AGD read-out from the sub-nonvolatile memory NVM2 to n bits (S103) and may store the expanded n bits of data BED in the main nonvolatile memory NVM1 as the first cumulative data CUD1 (S104). Alternatively, the memory controller MCP may store the lifespan data AGD in the main nonvolatile memory NVM1 as the first cumulative data CUD1 without expanding the bits of the read-out lifespan data AGD.

Then, the memory controller MCP may read out the first cumulative data CUD1 stored in the main nonvolatile memory NVM1 (S105).

The memory controller MCP may store the read-out first cumulative data CUD1 in the volatile memory VLM (S106).

The compensator CSP may receive the first cumulative data CUD1 stored in the volatile memory VLM from the memory controller MCP and may generate the lifespan data AGD based on the received first cumulative data CUD1 (S107).

Accordingly, in such an embodiment, even though at least the portion of the main nonvolatile memory NVM1 is damaged, the compensator CSP may compensate for the image data IMD based on the lifespan data AGD, and thus, may generate the lifespan compensation data ACD.

When the memory controller MCP determines that no damage exists in the main nonvolatile memory NVM1 while the display device is turned on, the memory controller MCP may read out previous second cumulative data PCD (refer to FIG. 9) stored in the main nonvolatile memory NVM1 (S102*a*). Then, the memory controller MCP may store the read-out previous second cumulative data PCD in the volatile memory VLM as the first cumulative data CUD1 (S106*a*). The previous second cumulative data PCD may be the second cumulative data CUD2 stored in the main nonvolatile memory NVM1 in the previous frame right before the power supply to the display device DD is cut off.

The compensator CSP may receive the first cumulative data CUD1 stored in the volatile memory VLM from the memory controller MCP and may generate the lifespan data AGD based on the received first cumulative data CUD1 (S107).

Referring to FIGS. 6 and 7, a first graph G1 and a second graph G2 in FIG. 7 show a luminance maintenance rate of the fixed area through which the first image IM1 (refer to FIG. 1) is displayed.

In FIG. 7, the first graph G1 shows the luminance maintenance rate of the fixed area in a case where at least the portion of the main nonvolatile memory NVM1 is damaged and the image data IMD is not compensated (hereinafter, a first case). The first graph G1 shows the decrease of the luminance maintenance rate of the fixed area.

In FIG. 7, the second graph G2 shows the luminance maintenance rate of the fixed area in a case where the image data IMD are compensated for using the lifespan data AGD stored in the sub-nonvolatile memory NVM2 even though at least the portion of the main nonvolatile memory NVM1 is damaged (hereinafter, a second case). The second graph G2 shows that the luminance maintenance rate of the fixed area is maintained.

In a case where at least the portion of the main nonvolatile memory NVM1 is damaged and the sub-nonvolatile memory NVM2 is not present (e.g., the first case), the compensator CSP may not receive the first cumulative data CUD1 in which the burn-in data of the pixels PX are accumulated up to immediately before the power supply to the display device DD is cut off when the display device is turned on. Accordingly, the image sticking compensation algorithm of the compensator CSP may not be normally operated, and thus, the deterioration of the pixels PX included in the fixed area may not be effectively compensated. Thus, the luminance maintenance rate of the fixed area gradually decreases.

In a case where the sub-nonvolatile memory NVM2 exists even though at least the portion of the main nonvolatile memory NVM1 is damaged (e.g., the second case), the compensator CSP may receive the first cumulative data CUD1 in which a portion of the burn-in data of the pixels PX up to immediately before the power supply to the display device DD is cut off is reflected based on the lifespan data AGD stored in the sub-nonvolatile memory NVM2 when the display device is turned on. Accordingly, the image sticking compensation algorithm of the compensator CSP may be normally operated, and the deterioration of the pixels PX included in the fixed area may be effectively compensated. As a result, the luminance maintenance rate of the fixed area may be restored to a level before the power supply to the display device DD is cut off.

In a section before the power supply to the display device DD is cut off (e.g., a first section Ta in FIG. 7), the compensator CSP may receive the second cumulative data CUD2 stored in the volatile memory VLM as the first cumulative data CUD1 through the memory controller MCP. Accordingly, the image sticking compensation algorithm of the compensator CSP may be normally operated, and thus, the luminance maintenance rate of the fixed area may be constantly maintained in both the first case and the second case.

In a section from which the display device DD is turned on again after the power supply has been cut off to which the compensator CSP receives the first cumulative data CUD1 through the memory controller MCP may be referred to as a second section Tb (e.g., a second section Tb in FIG. 7), the luminance maintenance rate of the fixed area may be lowered in both the first case and the second case.

In a section after the compensator CSP receives the first cumulative data CUD1 through the memory controller MCP (e.g., a third section Tc in FIG. 7), the luminance maintenance rate of the fixed area of the first case may be continuously lowered, and the luminance maintenance rate of the fixed area of the second case may be restored to the luminance maintenance rate of the first section Ta before the power supply to the display device DD is cut off.

Accordingly, in an embodiment where the image sticking compensator AIC includes the sub-nonvolatile memory NVM2, even though at least the portion of the main nonvolatile memory NVM1 is damaged, the image sticking may be prevented from being perceived by the viewer.

Figure 9:
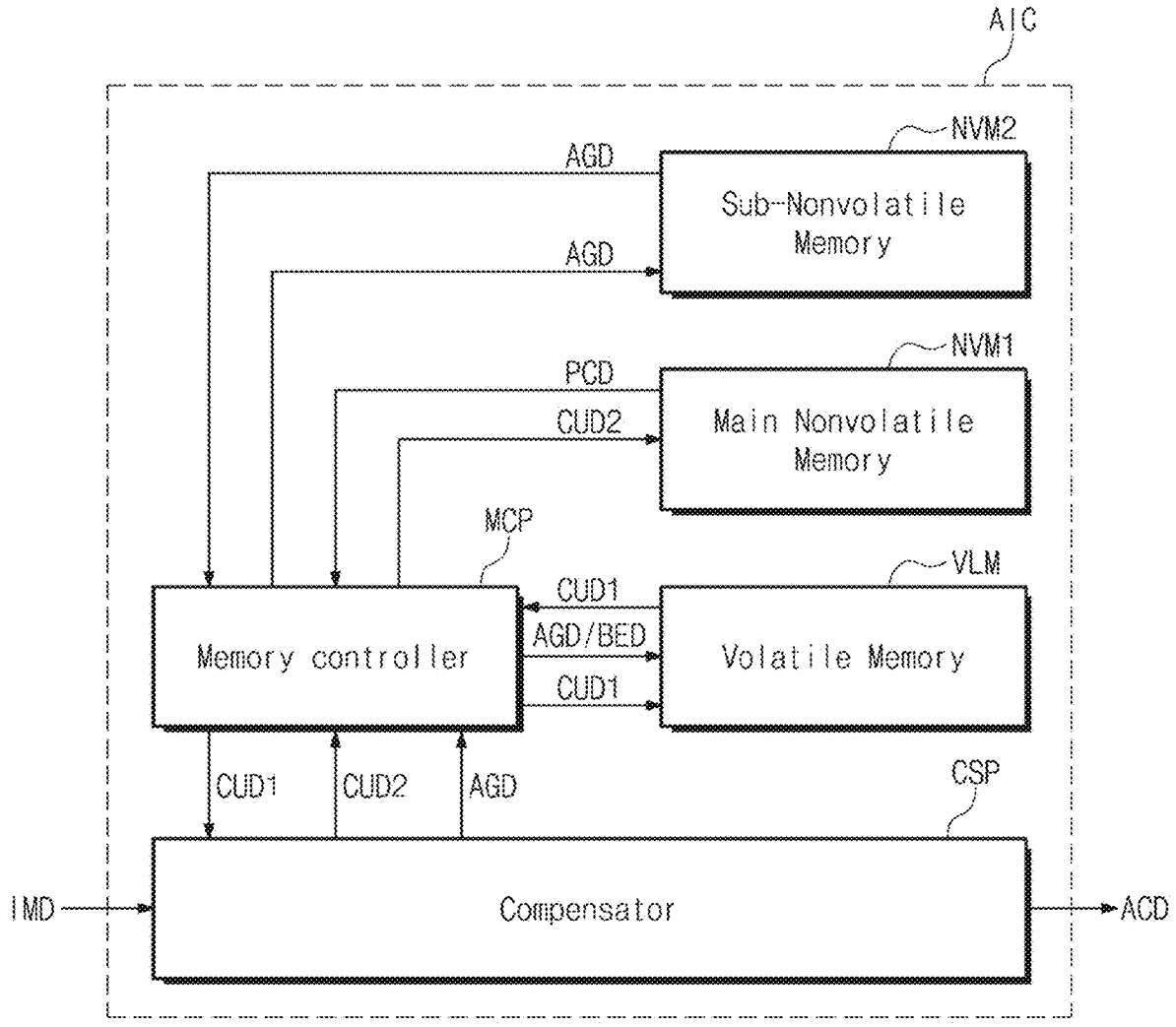
FIG. 9 is a block diagram showing an operation of the image sticking compensator when a display device is turned on according to an embodiment of the disclosure.
Figure 10:
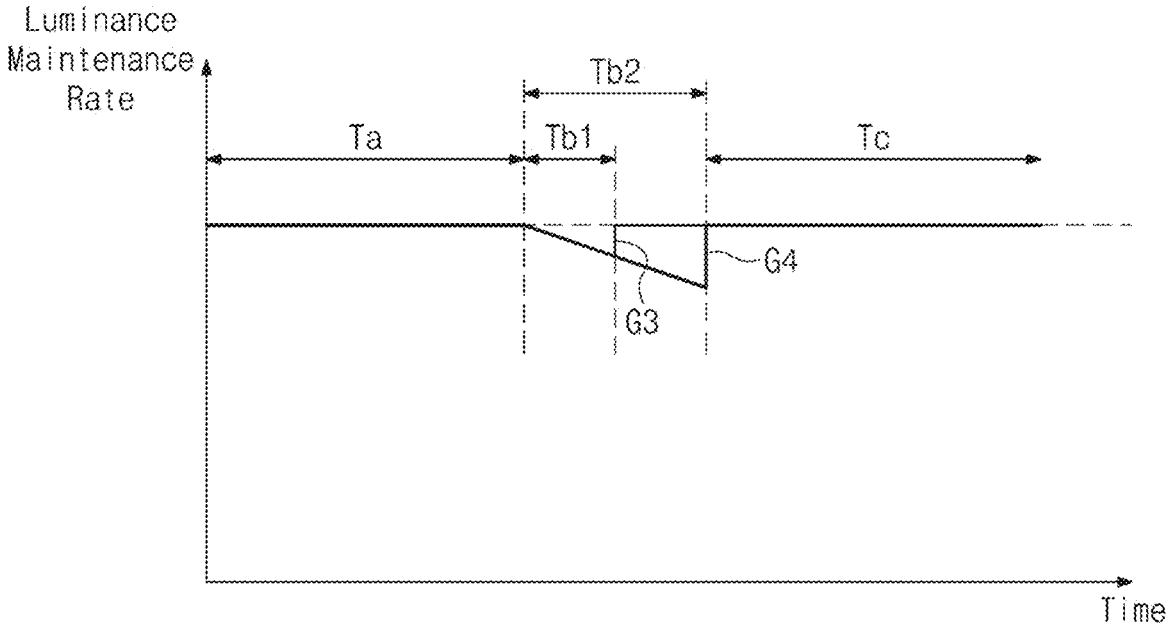
FIG. 10 is a graph showing an effect according to the operation of the image sticking compensator shown in FIG. 9.
Figure 11:
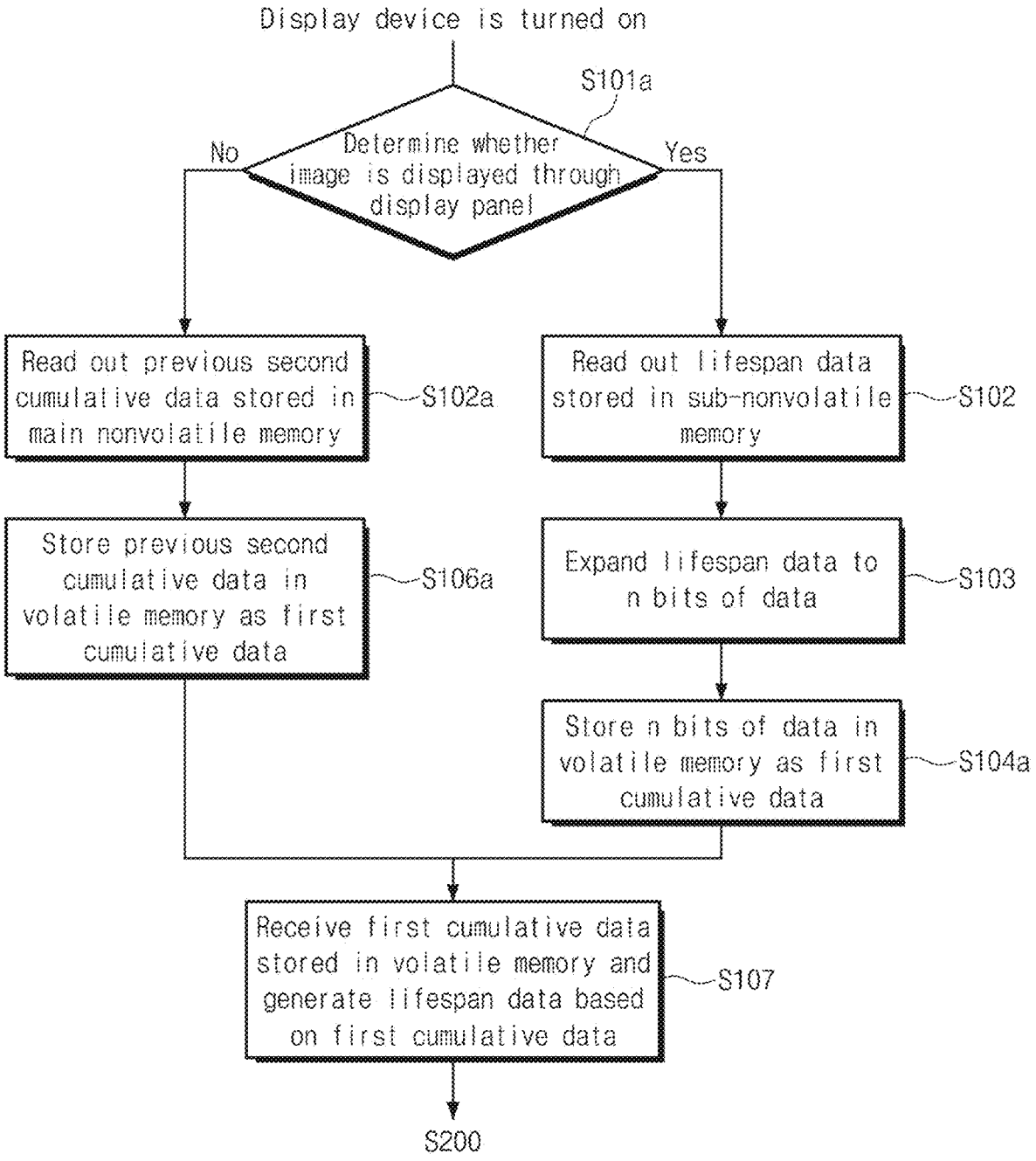
FIG. 11 is a flowchart showing an operation of the image sticking compensator shown in FIG. 9.

FIG. 9 is a block diagram showing an operation of the image sticking compensator AIC when the display device is turned on according to an embodiment of the disclosure. FIG. 10 is a graph showing an effect according to the operation of the image sticking compensator shown in FIG. 9. FIG. 11 is a flowchart showing an operation of the image sticking compensator shown in FIG. 9.

Hereinafter, any repetitive detailed descriptions of the same elements of FIG. 9 as those described above with reference to FIGS. 3 and 7 will be omitted.

Referring to FIGS. 9 and 11, in an embodiment, when the display device DD (refer to FIG. 2) is turned on, the memory controller MCP may perform different operations of storing the first cumulative data CUD1 into the volatile memory VLM depending on whether the image IM (refer to FIG. 1) is displayed through the display panel DP (refer to FIG. 2).

The memory controller MCP may determine whether the image IM is displayed through the display panel DP when the display device DD is turned on before the first cumulative data CUD1 are stored in the volatile memory NVM1 (S101*a*).

When it is determined that the image IM is displayed through the display panel DP, the memory controller MCP may read out the lifespan data AGD stored in the sub-nonvolatile memory NVM2 (S102). The memory controller MCP may expand the lifespan data AGD read-out from the sub-nonvolatile memory NVM2 to n bits (S103) and may store the expanded n bits of data BED in the volatile memory VLM as the first cumulative data CUD1 (S104*a*). Alternatively, the memory controller MCP may store the read-out lifespan data AGD in the volatile memory VLM as the first cumulative data CUD1 without expanding the bits of the read-out lifespan data AGD.

When it is determined that the image IM is not displayed through the display panel DP, the memory controller MCP may read out the previous second cumulative data PCD stored in the main nonvolatile memory NVM1 (S102*a*). Then, the memory controller MCP may store the read-out previous second cumulative data PCD in the volatile memory VLM as the first cumulative data CUD1 (S106*a*).

Referring to FIG. 10, a third graph G3 and a fourth graph G4 show the luminance maintenance rate of the fixed area in which the first image IM1 (refer to FIG. 1) is displayed.

In FIG. 10, the third graph G3 shows the luminance maintenance rate of the fixed area in a case where the memory controller MCP stores the first cumulative data CUD1 in the volatile memory VLM through the operation (S102) of reading out the lifespan data AGD from the sub-nonvolatile memory NVM2 while the display device DD is turned on (hereinafter, a third case).

In FIG. 10, the fourth graph G4 shows the luminance maintenance rate of the fixed area in a case where the memory controller MCP stores the first cumulative data CUD1 in the volatile memory VLM through the operation of reading out the previous second cumulative data PCD from the main nonvolatile memory NVM1 (S102*a*) while the display device DD (refer to FIG. 2) is turned on (hereinafter, a fourth case).

In an embodiment, the second section Tb may include or be divided into a first sub-section Tb1 and a second sub-section Tb2.

A section from which the display device DD is turned on again after the cutting-off of the power supply to which the compensator CSP receives the first cumulative data CUD1 through the memory controller MCP as the third case may be referred to as a first sub-section Tb1 as shown in FIG. 10.

A section from which the display device DD is turned on again after the cutting-off of the power supply to which the compensator CSP receives the first cumulative data CUD1 through the memory controller MCP as the fourth case may be referred to as a second sub-section Tb2 as shown in FIG. 10.

The previous second cumulative data PCD stored in the main nonvolatile memory NVM1 may be n-bits of data, and the lifespan data AGD stored in the sub-nonvolatile memory NVM2 may be m-bits of data. Accordingly, a time duration for the memory controller MCP to read out the lifespan data AGD stored in the sub-nonvolatile memory NVM2 may be shorter than a time duration for the memory controller MCP to read out the previous second cumulative data PCD stored in the main nonvolatile memory NVM1.

Thus, when the compensator CSP receives the first cumulative data CUD1 through the third case rather than the fourth case, a time duration for the compensator CSP to compensate for the image data IMD may be reduced.

Referring to the third and fourth graphs G3 and G4 in FIG. 10, the first sub-section Tb1 in which the luminance of the fixed area is lowered in the third case is shorter than the second sub-section Tb2 in which the luminance of the fixed area is lowered in the fourth case.

When the image sticking compensator AIC includes the sub-nonvolatile memory NVM2, the compensator CSP receives the first cumulative data CUD1 through the memory controller MCP as the third case. Accordingly, although the image IM is displayed through the display panel DP when the display device DD is turned on, a time duration for which the image data IMD is compensated and a time duration for which the image sticking is viewed to the user may be reduced.

Figure 12:
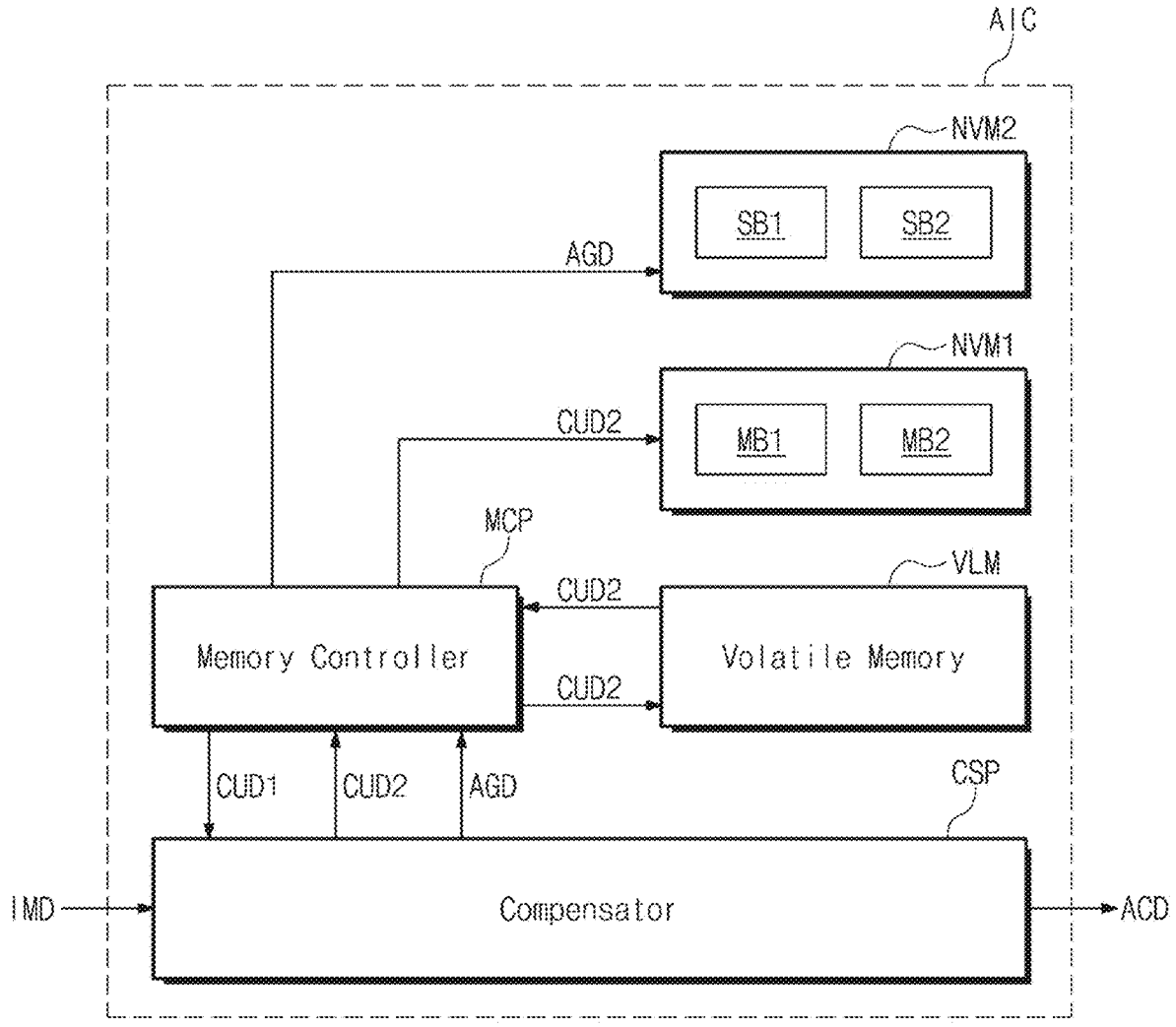
FIG. 12 is a block diagram showing an image sticking compensator according to an embodiment of the disclosure.

In the third period Tc, the compensator CSP may receive the first cumulative data CUD1 stored in the volatile memory VLM from the memory controller MCP and may generate the lifespan data AGD based on the received first cumulative data CUD1. FIG. 12 is a block diagram showing an image sticking compensator AIC according to an embodiment of the disclosure.

Hereinafter, any repetitive detailed descriptions of the same elements of FIG. 12 as those described with reference to FIG. 3A will be omitted.

Referring to FIG. 12, in an embodiment, a main nonvolatile memory NVM1 may include a first main block MB1 and a second main block MB2. A memory controller MCP may alternately store second cumulative data CUD2 in the first main block MB1 and the second main block MB2. In one embodiment, for example, the main nonvolatile memory NVM1 may include two or more main blocks.

In such an embodiment, as the memory controller MCP alternately stores the second cumulative data CUD2 in the first and second main blocks MB1 and MB2, even though one main block of the first and second main blocks MB1 and MB2 is damaged, the memory controller MCP may read out the second cumulative data CUD2 from the other main block of the first and second main blocks MB1 and MB2.

A sub-nonvolatile memory NVM2 may include a first sub-block SB1 and a second sub-block SB2. The memory controller MCP may alternately store lifespan data AGD in the first sub-block SB1 and the second sub-block SB2. In one embodiment, for example, the sub-nonvolatile memory NVM2 may include two or more sub-blocks.

In such an embodiment, as the memory controller MCP alternately stores the lifespan data AGD in the first and second sub-blocks SB1 and SB2, even though one sub-block of the first and second sub-blocks SB1 and SB2 is damaged, the memory controller MCP may read out the lifespan data AGD from the other sub-block of the first and second sub-blocks SB1 and SB2.

The invention should not be construed as being limited to the embodiments set forth herein. Rather, these embodiments are provided so that this disclosure will be thorough and complete and will fully convey the concept of the invention to those skilled in the art.

While the invention has been particularly shown and described with reference to embodiments thereof, it will be understood by those of ordinary skill in the art that various changes in form and details may be made therein without departing from the spirit or scope of the invention as defined by the following claims.

What is claimed is:

1. A display device comprising:

a display panel which displays an image;

an image sticking compensator which receives image data, compensates for the image data based on lifespan data to generate lifespan compensation data, and stores second cumulative data and the lifespan data; and a panel driver which provides data signals corresponding to the lifespan compensation data to the display panel to drive the display panel, wherein the image sticking compensator comprises:

a compensator which receives first cumulative data, generates the lifespan data based on the first cumulative data, compensates for the image data based on the lifespan data to generate the lifespan compensation data, and generates the second cumulative data based on the first cumulative data;

a memory controller which receives the second cumulative data and the lifespan data from the compensator, wherein the compensator receives the first cumulative data from the memory controller;

a volatile memory which receives the second cumulative data from the memory controller and stores the received second cumulative data;

a main nonvolatile memory which receives the second cumulative data from the memory controller and stores the received second cumulative data; and a sub-nonvolatile memory which receives the lifespan data from the memory controller and stores the received lifespan data, wherein the compensator generates burn-in data of a current frame based on the lifespan compensation data, the first cumulative data are data generated by accumulating the burn-in data up to an immediately previous frame, and the second cumulative data are data generated by accumulating the burn-in data of the current frame on the first cumulative data.

2. The display device of claim 1, wherein the sub-nonvolatile memory has a storage capacity less than a storage capacitor of the main nonvolatile memory.

3. The display device of claim 1, wherein the first and second cumulative data comprise n bits of data, the lifespan data comprise m bits of data, each of n and m is a natural number equal to or greater than 1, and n is greater than m.

4. The display device of claim 1, wherein the compensator receives the first cumulative data from the memory controller, and when the display device is turned on, the memory controller reads out previous second cumulative data stored in the main nonvolatile memory in the immediately previous frame and stores the read-out previous second cumulative data in the volatile memory as the first cumulative data.

5. The display device of claim 4, wherein the memory controller reads out the lifespan data stored in the sub-nonvolatile memory and stores the read-out lifespan data in the main nonvolatile memory when at least a portion of the main nonvolatile memory is damaged.

6. The display device of claim 5, wherein the memory controller expands the lifespan data to n bits of data and stores the expanded lifespan data in the main nonvolatile memory.

7. The display device of claim 4, wherein the memory controller reads out the lifespan data stored in the sub-nonvolatile memory and stores the read-out lifespan data in the volatile memory as the first cumulative data when the display device is turned on.

8. The display device of claim 7, wherein the memory controller expands the lifespan data to n bits of data and stores the expanded lifespan data in the volatile memory as the first cumulative data.

9. The display device of claim 1, wherein the memory controller reads out the second cumulative data stored in the volatile memory at a predetermined first period and stores the read-out second cumulative data in the main nonvolatile memory, and the memory controller receives the lifespan data from the compensator at a predetermined second period and stores the received lifespan data in the sub-nonvolatile memory.

10. The display device of claim 9, wherein the first period and the second period are set to be different from each other.

11. The display device of claim 1, wherein the main nonvolatile memory comprises:

a first main block; and a second main block, wherein the memory controller alternately stores the second cumulative data in the first main block and the second main block.

12. The display device of claim 1, wherein the sub-nonvolatile memory comprises:

a first sub-block; and a second sub-block, wherein the memory controller alternately stores the lifespan data in the first sub-block and the second sub-block.

13. The display device of claim 1, wherein the display panel further comprises a controller which receives an image signal from an outside and generates the image data based on the image signal.

14. A method of driving a display device, the method comprising:

receiving image data and first cumulative data;

generating lifespan compensation data by compensating for the image data based on lifespan data;

storing second cumulative data and the lifespan data;

providing data signals corresponding to the lifespan compensation data to a display panel of the display device; and displaying an image corresponding to the data signals, wherein the generating the lifespan compensation data comprises:

generating burn-in data of a current frame based on the lifespan compensation data;

receiving the first cumulative data to generate the lifespan data based on the first cumulative data; and compensating for the image data based on the lifespan data to generate the lifespan compensation data, wherein the storing the second cumulative data and the lifespan data comprises:

generating the second cumulative data based on the first cumulative data;

storing the second cumulative data in a volatile memory by receiving the second cumulative data from a memory controller of the display device;

storing the second cumulative data in a main nonvolatile memory by receiving the second cumulative data from the memory controller; and storing the lifespan data in a sub-nonvolatile memory by receiving the lifespan data from the memory controller, wherein the first cumulative data are data generated by accumulating the burn-in data up to an immediately previous frame, the second cumulative data are data generated by accumulating the burn-in data of the current frame on the first cumulative data.

15. The method of claim 14, wherein the sub-nonvolatile memory has a storage capacity less than a storage capacity of the main nonvolatile memory.

16. The method of claim 15, wherein the first and second cumulative data comprise n bits of data, the lifespan data comprise m bits of data, each of n and m is a natural number equal to or greater than 1, and n is greater than m.

17. The method of claim 16, wherein the generating the lifespan compensation data further comprises:

reading out the lifespan data stored in the sub-nonvolatile memory when at least a portion of the main nonvolatile memory is damaged;

expanding the read-out lifespan data to n bits of data; and storing the expanded lifespan data in the main nonvolatile memory as the first cumulative data.

18. The method of claim 16, wherein the generating the lifespan compensation data further comprises:

reading out the lifespan data stored in the sub-nonvolatile memory when the display device is turned on;

expanding the read-out lifespan data to n bits of data; and storing the expanded lifespan data in the volatile memory as the first cumulative data.

19. The method of claim 14, wherein the storing the second cumulative data in the main nonvolatile memory comprises:

storing the second cumulative data in a first main block of the main nonvolatile memory; and storing the second cumulative data in a second main block of the main nonvolatile memory, and the storing the lifespan data in the sub-nonvolatile memory comprises:

storing the lifespan data in a first sub-block of the sub-nonvolatile memory; and storing the lifespan data in a second sub-block of the sub-nonvolatile memory.

* * * * *